US006154354A

United States Patent [19]

Alexanian

[11] Patent Number: 6,154,354

[45] Date of Patent: Nov. 28, 2000

[54] DEVICE FOR OPERATING LATCHING SOLENOIDS

[76] Inventor: George Alexanian, 4761 W. Jacquelyn Ave., Fresno, Calif. 93722

[21] Appl. No.: 09/183,280

[22] Filed: Oct. 30, 1998

[51] Int. Cl.[7] ..... H01H 47/04

[52] U.S. Cl. ..... 361/160; 361/154

[58] Field of Search ..... 361/160, 152–156

[56] References Cited

U.S. PATENT DOCUMENTS 4,686,604 8/1987 Gilman ..... 361/155
4,716,490 12/1987 Alexanian ..... 361/155
4,774,623 9/1988 Gilman ..... 361/155
5,347,421 9/1994 Alexanian ..... 361/156

*Primary Examiner*—Fritz Fleming
*Attorney, Agent, or Firm*—Mark D. Miller

[57] ABSTRACT

Disclosed are reliable DC circuits for operating latching solenoids at distances of up to several miles. The circuits allow the use of ordinary gauge buried copper wire without concern for possible deterioration of the wires from the galvanic effect of the inductive field created by the buried wires carrying the direct current. The circuits are simple, inexpensive to build, and extremely energy efficient, and provide an effective deterrent to lightning-induced damage. They significantly reduce the current required by the solenoid, and are compatible for use with battery operated systems.

18 Claims, 2 Drawing Sheets

DEVICE FOR OPERATING LATCHING SOLENOIDS

BACKGROUND OF THE INVENTION

The present invention relates to controlling irrigation valves, and more particularly to a new and improved device for controlling latching solenoids over great distances using low voltage direct current (DC).

FIELD OF THE INVENTION

In the field of watering systems, low voltage solenoids are commonly used as actuators to open and close water valves. A solenoid enlisted for such a purpose is generally situated in close proximity or attached to the valve it is to control. In commercial agricultural and horticultural situations, such valves may be in remote locations that can be hundreds or even thousands of feet from the nearest power source. Insufficient voltage or current at the valve is a common problem where long distances or multiple valves are involved.

Reliable operation of water valve solenoids is essential to ensure that water is regularly delivered to plants. Typical irrigation systems are designed to use 24 volts of alternating current (AC) to activate and control electric solenoids. However, AC powered irrigation systems suffer from several drawbacks. First, AC voltage drops over long runs of wire such that reliable voltage delivery cannot be assured beyond a few thousand feet. Where multiple solenoids are operated by a single controller, long runs of parallel wires in close proximity to each other may result in capacitive coupling: leakage current and floating voltages induced by energized adjacent wires. This effect may cause unwanted valves to turn on, or fail to cause valves to turn off. Other problems with AC systems include potential burn out of solenoids close to the controller because of excessive primary voltage.

Irrigation valve controlling systems also generally suffer from susceptibility to lightning, and power outages. A lightning strike on a valve in the field can couple onto the buried wires and run back to the controller with devastating results. A power outage can interrupt irrigation cycles potentially inducing stress to vegetation.

A conventional solution to the problem of AC voltage drops over long runs of wire is to provide thick, low-gauge solid wire (e.g. 8 gauge solid copper wire) which has a lower resistance factor than the thinner, higher-gauge wire. This solution provides a reliable method of controlling remote solenoids by decreasing voltage drops. However, the high cost of long runs of low-gauge wire becomes prohibitive, especially when several runs are required to operate several remote solenoids simultaneously. In addition, since the wires are carrying AC, the capacitative coupling problem is still present.

Another proposed solution is to provide direct current (DC) voltage through long runs of copper wire to the solenoids, since DC systems do not suffer from the capacitive coupling problems of AC systems. However, when copper wires carry DC for long periods of time, the galvanic effect of the inductive field created by buried wires carrying the direct current causes the copper in the wires themselves to deteriorate over time, resulting in unreliability and eventually requiring replacement. For this reason, such DC systems are only used in short distance, above ground installations. These systems also suffer from the general problems presented by lightning strikes and power outages.

A third option is to provide a DC power source at the same remote location as the valve itself utilizing on-site batteries, solar power, or an on-site diesel generator. The disadvantage of this approach is the high cost of a self-contained remote system, and the problems of reliability in the event batteries or generator fail, or the weather is overcast for several days.

My 1994 patent (U.S. Pat. No. 5,347,421) addresses these problems to some extent by providing an AC power saving module in the form of a local circuit for energizing a solenoid. However, the circuits described in the '421 patent require a constant (albeit very low) current flow while the valve is open. The low AC current requirements of the '421 circuits allow much longer or thinner wire runs; however, since the wires are carrying AC, the capacitative coupling problem is still present.

SUMMARY OF THE INVENTION

The present invention provides a reliable DC circuit for operating latching solenoids at distances of up to several miles. The circuits allow the use of ordinary gauge buried copper wire without concern for possible deterioration of the wires from the galvanic effect of the inductive field created by the buried wires carrying the direct current. The circuits of the present invention also provide an effective deterrent to lightning-induced damage, significantly reduce the current required by the solenoid, and are compatible for use with battery operated systems. The circuits are simple, inexpensive to build, and energy efficient.

The most basic circuit of the present invention includes a pair of lines from a DC power supply. These power lines are first attached to a relay which controls a set of contacts. When DC power is applied, the relay causes the contacts to close such that a capacitor or other DC charge storage device is included in the circuit. After a given time interval, depending upon the voltage level provided from the power source, the capacitor becomes substantially fully charged. The power is then shut off at the source which causes the relay to release the contacts which return to their original positions. This causes a secondary circuit to be completed which includes the capacitor and a latching DC solenoid. The completion of this circuit causes the charge in the capacitor to be discharged into the latching solenoid, activating it. Depending upon the polarity of the incoming DC power, the discharge of the capacitor will either open or close the solenoid. The release of the contacts also disconnects the secondary solenoid circuit from the power supplying circuit, thereby eliminating potential lightning strike problems that would otherwise be present with a direct link back to the source.

The solenoid itself is of the latching variety, which means that once it is activated (opened or closed), it remains that way without the requirement of a constant current running through it. This provides the added benefit of extending the life of the solenoid since the coil thereof is not exposed to constant current which might result in overheating and failure.

It is therefore a primary object of the present invention to provide a reliable remote circuit that may be attached to a far distant DC power supply for use in operating a latching solenoid attached to a water supply valve.

It is a further important object of the present invention to provide a reliable remote DC circuit for use in operating a solenoid attached to a water supply valve which saves energy by requiring very low current to operate the solenoid.

It is a further important object of the present invention to provide a reliable remote DC circuit for use in operating a latching solenoid attached to a water supply valve requiring a very low current to activate or deactivate the latching solenoid.

It is a further object of the present invention to provide a secondary circuit which includes a capacitor and a latching solenoid that is automatically disconnected from the DC power source when not in use thereby avoiding potential lightning strike problems.

It is a further object of the present invention to provide a reliable circuit for operating a latching solenoid that may be attached to an DC power source over a long run of high gauge (low cost) copper wire without any galvanic effect.

It is a further object of the present invention to provide a remote circuit for operating a latching solenoid attached to a water supply valve that may be battery operated.

It is a further object of the present invention to provide a remote device for operating a latching solenoid that allows for considerable savings in the costs for electric current and the costs associated with great lengths of low (larger) gauge wire.

Other objects of the invention will be apparent from the detailed descriptions and the claims herein.

DETAILED DESCRIPTION OF THE PREFERRED EMBODIMENTS

Figure 4:
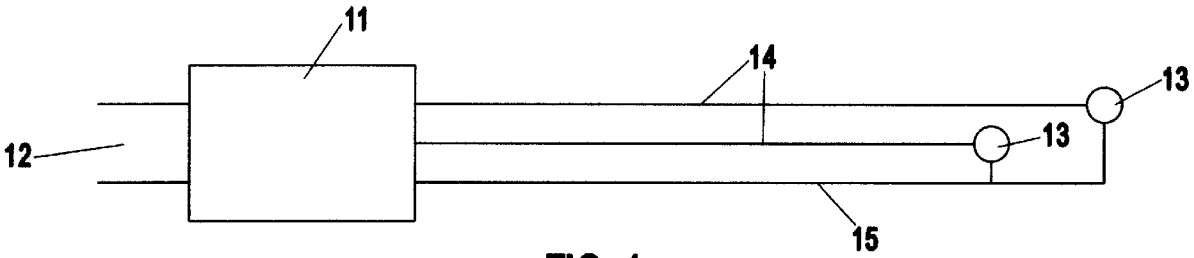
FIG. 4 is a schematic diagram of a prior art AC circuit for activating a solenoid.

Referring to the drawings wherein like reference characters designate like or corresponding parts throughout the several views, and referring first to the prior art circuit of FIG. 4, it is seen that a typical AC solenoid controller 11 is connected to a 115 volt AC input 12. Controller 11 is typically located at a central location and may be several hundred or several thousand feet from solenoids 13. A great deal of power (500 milliamps) is required to operate these solenoids; the proximity of output lines 14 and common line 15 may result in capacitive coupling; and the direct link between the solenoids and the controller exposes the controller to damage from lightning strikes.

Figure 5:
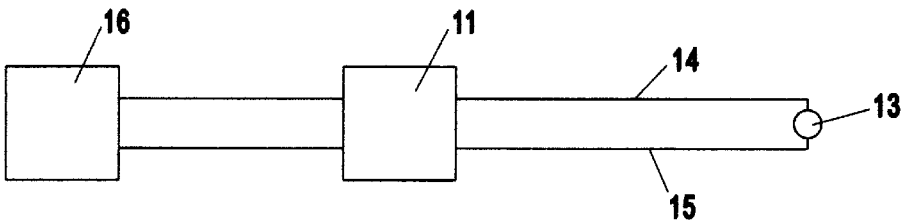
FIG. 5 is a schematic diagram of a prior art DC circuit for activating a solenoid.

Referring to the prior art DC circuit of FIG. 5, it is seen that a battery source 16 is connected to a controller 11 to provide DC current, and that DC current is supplied down lines 14 and 15 leading to a solenoid 13. Such circuits are limited to being able to only operate one solenoid at a time, and the copper wires 14 and 15 cannot be buried in the ground or they will be exposed to galvanic deterioration.

Figure 1:
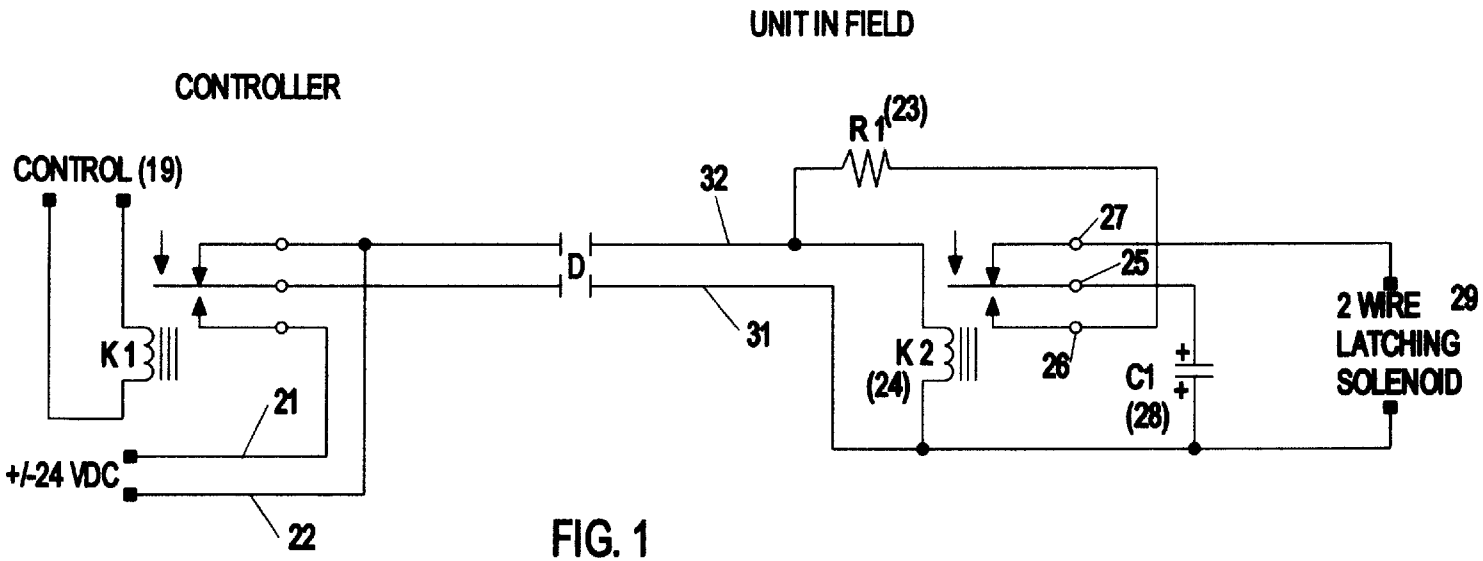
FIG. 1 is a schematic diagram of an actuator circuit of the present invention with controller for use in a commercial environment.
Figure 2:
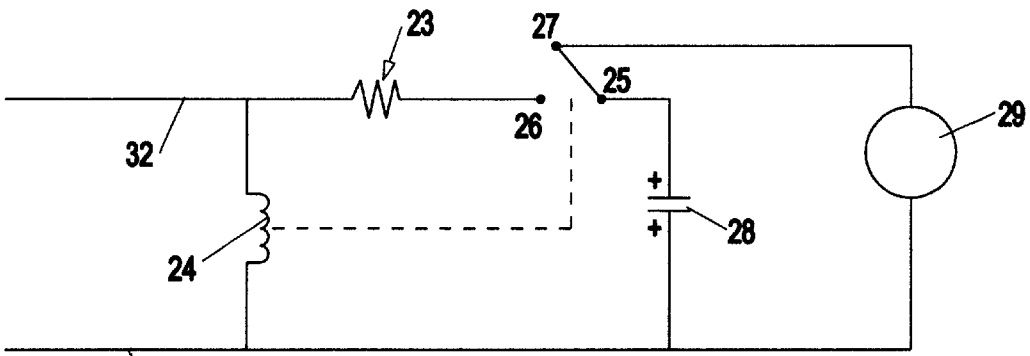
FIG. 2 is another schematic diagram of the actuator circuit of the present invention for use in a commercial environment.
Figure 3:
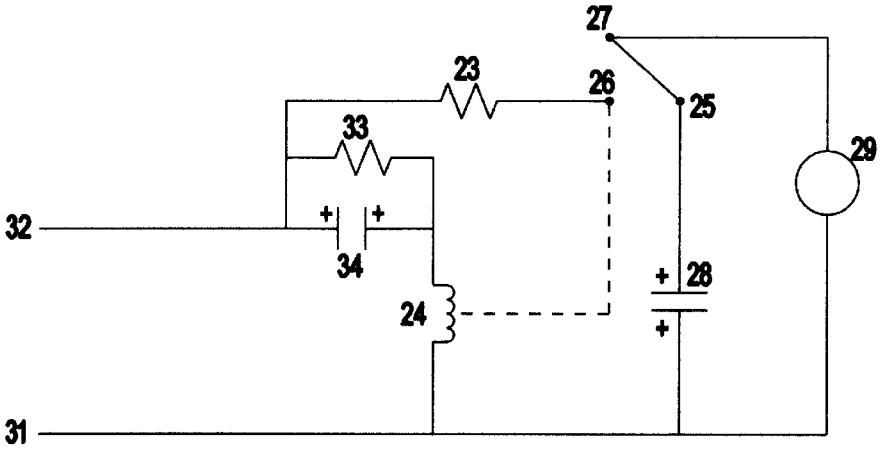
FIG. 3 is a schematic diagram of an alternative embodiment of the actuator circuit of the present invention.

Referring then to FIGS. 1, 2 and 3, it is seen that the present invention includes a circuit having input leads 31 and 32 from a direct current (DC) power source (or controller) 19. Circuitry within the controller determines the polarity of the power provided to lines 31 and 32, depending on whether such power is being sent to latch (normal polarity) or unlatch (reverse polarity) the solenoid. A relay coil 24 (K2) is provided on lines 31 and 32. When a DC voltage is applied to coil 24, it closes contacts 25 and 26. This brings capacitor 28 (C1) and resister 28 (R1) into the circuit, causing the capacitor 28 to become charged over resistor 23.

When a DC voltage is applied to the relay coil, the only current draw is to that coil. For illustrative purposes, a typical coil may draw approximately 15 milliamps, although coils having a much lower draw could be used. This load would be considered the inrush current in normal solenoid operation. Since the inrush and holding current are the same in DC operations, this is also the holding current. Including the resistor 23 could add, for example, about 5 milliamps for a total of 20. of course different combinations of coils and resistors could be used to bring down the draw to as little as 10 total milliamps. This compares to the very high inrush current required by AC solenoids (on the order of 500 milliamps) which is eliminated in the DC circuit of the present invention.

After a time interval sufficient to charge capacitor 28 (usually only a few seconds), the DC power is removed from the circuit, causing the coil and the relay to drop out. This causes contacts 25 and 27 to connect. This results in the completion of a secondary circuit involving capacitor 28 and latching solenoid 29 whereby capacitor 28 discharges into solenoid 29 causing it to latch. Later, when it is time to unlatch the solenoid, DC power with reversed polarity is applied to lines 31 and 32. Relay 24 is once again activated for a few seconds, sufficient for capacitor 28 to again become charged, this time with opposite polarity. When power is removed from the circuit, relay 24 drops out and contacts 25 and 27 are again joined. This results in an oppositely polarized discharge from capacitor 28 to solenoid 29 causing it to unlatch.

The galvanic effect of buried copper wires carrying DC power is virtually eliminated with this circuit since the DC power is only applied over lines 31 and 32 for very short time intervals (5 to 10 seconds) and only at the beginning and at the end of the valve operation. Accordingly, very little current is expended at all, making the invention ideal for use in battery operated systems. This compares to the constant holding currents required in standard 24 volt AC systems (on the order of 250 milliamps), and those required in my '421 device (on the order of 60 milliamps) which, although small, would not be ideal for battery operation.

Since this is a DC system, there is no capacitive coupling or floating voltage problem. Multiple valves can be operated in parallel with this design, as many as 20 at a time if needed, which is common in agricultural applications.

One of the most significant advantages of the present system are the very long distances that a valve can be placed away from a controller. A known controller advertises a distance of up to 800 feet between controller and valve using 14 gauge wire. However, the present invention using 14 gauge wire allows a round trip distance of over 19 miles! In particular, 14 gauge wire has a known resistance of approximately 2.5 ohms per 1000 ft. Allowing 500 ohms of resistance over the line (which reserves as much as 1500 ohms for the relay coil 24 and resistor 23) results in an available distance of 200,000 feet. This translates to 38.02 miles, or a distance D of over 19 miles between controller and circuit. Using much smaller 20 gauge wire having a known resistance of 10 ohms per 1000 ft., and again allowing 500 ohms of resistance over the wire, the result is still 50,000 feet which translates to 9.47 miles or a distance D (see FIG. 1) of over 4.7 miles between controller and circuit.

In the alternative embodiment of FIG. 3, the DC pulse still arrives across lines 31–32. Relay coil 24 is activated (closing contacts 25 and 26) through by the initial DC voltage through capacitor 34. Once activated, capacitor 34 becomes fully charged and opens so that coil 24 is held activated by means of the voltage through resistor 33. Since the typical holding voltage of a DC relay coil is ten percent (10%) of the nominal (activating) voltage, a resistor on the order of two to three times the coil DC resistance should be adequate to keep the relay activated as long as the DC pulse is present across input 31–32.

As a result of this alternate design, the current to the circuit is further reduced by approximately another 50% on the average from the circuit of FIG. 2. The average DC current can thereby be on the order of about 10 milliamps. By this further reduction, twice the distance can be attained (because of half of the current) from FIG. 2. In addition, this further reduces the current demand on the controller DC supply, doubling its life expectancy. Or, alternately, twice as many valves can be operated with the design of FIG. 3.

For illustrative purposes and by way of example only, and without limiting the scope of the appended claims herein, using a 24 volt DC power source, a relay coil 24 may be selected having a resistance of 1500 ohms, a resistor 23 may be selected having a resistance of as high as 5000 ohms, a non-polarity sensitive capacitor 28 may be selected having a capacitance of 1000 microfarads ($\mu$F) at 25 volts, and a latching solenoid 29 may be selected having a coil resistance of between 5 and 10 ohms. If the relay coil requires 15 volts for activation, then approximately 937.5 ohms of calculated resistance are available for the wire. This is based on solving the equation R=E/I (Resistance=Voltage/Current) with 15 volts (pull in voltage of relay) to 24 volts (supplied voltage) with coil resistance of 1500 ohms. Using 14 gauge wire at 2.5 ohms of resistance per 1000 ft., this translates into a distance of 375,000 feet (over 70 miles); using 20 gauge wire at 10 ohms of resistance per 1000 ft. this translates into a distance of 93,700 (over 17.7 miles).

Establishing the values of these circuit parts requires making a determination of the energy needed to reliably activate the solenoid under field conditions. This will fix the value of capacitor 28. Then the resistance of resistor 23 must be established. This will be a compromise between the desired maximum distance of the wire run and the time required to charge the capacitor. A high resistance, long wire run would add to the charge time of the capacitor by adding the wire resistance to that of resistor 23. Typically, this may add as much as another ten percent (10%) of charge time, since a wire resistance of 500 ohms in series with resistor 23 having a resistance of 5000 ohms is ten percent (10%). Once the capacitor, resistor and wire lengths are determined, the time interval for charging the capacitor can be computed. Normally a charging time of between 5 and 10 seconds is adequate for this purpose. This time can be programmed into the controller software for a precisely timed DC pulse.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

I claim:

1. A device for energizing a latching solenoid from a great distance using DC (direct current) comprising a controller capable of providing a DC voltage for a timed interval, and capable of reversing the polarity of said DC voltage two lines for bringing said DC voltage over a great distance from said controller to a circuit, said circuit comprising an activatable switching means connected to said input lines for controlling a set of alternative contacts, said contacts being capable of closing in order to complete a first sub-circuit in parallel with said switching means or opening to complete a second sub-circuit including said solenoid, said first sub-circuit including a resistance means between one of said input lines and said contacts and a non-polarity sensitive DC charge storage means between said other input line and said contacts, said solenoid being connected to a line between said other input line and said contacts.

2. The device described in claim 1 wherein a low voltage DC current is supplied on said input lines for a timed interval, said switching means closes said contacts resulting in the storage of a charge in said DC charge storage means, such that at the end of said interval when all current to the circuit is eliminated, said switching means drops out causing said contacts to open resulting in the discharge of the DC charge storage means into a first lead on said solenoid.

3. The device described in claim 2 wherein said controller supplies oppositely polarized low voltage DC current for a timed interval such that said DC charge storage means discharges into an opposite lead on said solenoid.

4. The device described in claim 1 wherein a second DC charge storage means is provided in series with said switching means, and a second resistance means is provided in a separate series with said switching means.

5. The device described in claim 4 wherein a low voltage DC current is supplied on said input lines for a timed interval, said switching means is activated closing said contacts resulting in the storage of a charge in both of said DC charge storage means, whereupon as said second DC charge storage means becomes fully charged, said switching means is maintained through said second resistance means, and at the end of said interval when all current to the circuit is eliminated, said switching means drops out causing said contacts to open resulting in the discharge of said first DC charge storage means into one lead on said solenoid.

6. The device described in claim 5 wherein by supplying oppositely polarized low voltage DC current, said first DC charge storage means discharges into an opposite lead on said solenoid.

7. A device for energizing a latching solenoid on a DC (direct current) line comprising:

a. a controller capable of providing a DC voltage for a timed interval and capable of reversing the polarity of said DC voltage;

b. two input lines for bringing said DC voltage over a distance from said controller to a remote circuit;

c. a switching means connected in said circuit, said switching means controlling a set of alternative contacts in line with one terminal of said solenoid;

d. a resistance means and a non-polarity sensitive DC charge storage means connected in said circuit in parallel to said switching means, said resistance means separated from said DC charge storage means by the contacts controlled by said switching means;

e. a line connecting said DC charge storage means with the opposite terminal of said solenoid.

8. The device described in claim 7 wherein a low voltage DC current is supplied on said input lines for a timed interval causing said switching means to close said contacts resulting in the storage of a charge in said DC charge storage means, such that at the end of said interval, said switching means drops out causing said contacts to open resulting in the discharge of the DC charge storage means into one terminal of said solenoid.

9. The device described in claim 8 wherein oppositely polarized low voltage DC current is supplied for a timed interval such that said DC charge storage means discharges into the opposite terminal on said solenoid.

10. The device described in claim 7 wherein a second DC charge storage means is provided in series with said switching means, and a second resistance means is provided in a separate series with said switching means.

11. The device described in claim 10 wherein a low voltage DC current is supplied on said input lines for a timed interval causing said switching means to activate closing said contacts resulting in the storage of a charge in both of said DC charge storage means, whereupon as said second DC charge storage means becomes fully charged, said switching means is maintained through said second resistance means, and at the end of said interval, said switching means drops out causing said contacts to open resulting in the discharge of said first DC charge storage means into one terminal on said solenoid.

12. The device described in claim 11 wherein by supplying oppositely polarized low voltage DC current, said first DC charge storage means discharges into the opposite terminal on said solenoid.

13. A device for energizing a latching solenoid with DC (direct current) comprising two a controller attached to a circuit by DC lines, said controller being capable of providing a DC voltage for a timed interval and capable of reversing the polarity of said DC voltage for activating a switching means for controlling a set of contacts which alternate between a closed position to complete a first sub-circuit having a first resistor in series with a DC charge storage means and an open position to complete a second sub-circuit having said latching solenoid in series with said charge storage means.

14. The device of claim 13 wherein a second resistor is provided in said first sub-circuit between one of said input lines and said contacts.

15. The device of claim 14 wherein a non-polarity sensitive DC charge storage means is provided in said first sub-circuit in parallel with said second resistor.

16. The device of claim 15 wherein a said solenoid is connected to a line between said other input line and said contacts.

17. A method for controlling a distant latching solenoid comprising the steps of:

a. supplying a pulse of low voltage direct current on a pair of lines which extend a great distance for a measured time interval in order to activate a switching means for controlling a set of contacts during said time interval such that said contacts close in order to provide direct current to a DC charge storage means;

b. withdrawing said direct current pulse at the conclusion of said measured time interval in order to deactivate said switching means such that said contacts open causing completion of a sub-circuit so that said DC charge storage means discharges into said latching solenoid;

c. waiting for a time interval:

d. supplying an oppositely polarized pulse of low voltage direct current on said pair of lines for a measured time interval in order to activate said switching means contacts during said time interval such that said contacts close in order to provide oppositely polarized direct current to said DC charge storage means; and e. withdrawing said oppositely polarized direct current pulse at the conclusion of said measured time interval in order to deactivate said switching means such that said contacts open causing completion of a sub-circuit so that said DC charge storage means discharges into an opposite lead on said latching solenoid.

18. A method for controlling a remote switch comprising the steps of:

a. supplying a pulse of low voltage direct current on a pair of lines which extend a great distance for a measured time interval in order to activate a switching means for controlling a set of contacts during said time interval such that said contacts close in order to provide direct current to a DC charge storage means;

b. withdrawing said direct current pulse at the conclusion of said measured time interval in order to deactivate said switching means such that said contacts open causing completion of a sub-circuit so that said DC charge storage means discharges into said remote switch;

c. waiting a time interval;

d. supplying an oppositely polarized pulse of low voltage direct current on said pair of lines for a measured time interval in order to activate said switching means during said time interval such that said contacts close in order to provide oppositely polarized direct current to said DC charge storage means; and e. withdrawing said oppositely polarized direct current pulse at the conclusion of said measured time interval in order to deactivate said switching means such that said contacts open causing completion of a sub-circuit so that said DC charge storage means discharges into an opposite lead on said remote switch.

* * * * *

UNITED STATES PATENT AND TRADEMARK OFFICE

CERTIFICATE OF CORRECTION

PATENT NO. : 6,154,354
DATED : November 28, 2000
INVENTOR(S) : George Alexanian

It is certified that error appears in the above-identified patent and that said Letters Patent is hereby corrected as shown below:

Column 4,
Line 1, "resister 28" should be "resister 23".

Column 5,
Line 64, insert a comma between "voltage" and "two".

Column 7,
Line 23, change "two" to "of".

Signed and Sealed this

Second Day of October, 2001

*Attest:*

Nicholas P. Godici

NICHOLAS P. GODICI
*Acting Director of the United States Patent and Trademark Office*

*Attesting Officer*